United States Patent [19]

Miller

[11] 4,385,239

[45] May 24, 1983

[54] INERTING CHAMBER FOR ELECTRON CURING OF RESIN COATED WEBS

[75] Inventor: Alton K. Miller, Niagara Falls, N.Y.

[73] Assignee: Kennecott Corporation, Stamford, Conn.

[21] Appl. No.: 255,980

[22] Filed: Apr. 20, 1981

[51] Int. Cl.[3] ..... G21K 5/10; B05D 3/06

[52] U.S. Cl. ..... 250/492.3; 250/492.1; 250/400; 427/44; 427/35

[58] Field of Search ..... 250/492.3, 492.1, 400; 427/35, 44; 51/298 R; 118/621

[56] References Cited

U.S. PATENT DOCUMENTS

| | | |
|---|---|---|
| 3,022,593 | 2/1962 | Baird, Jr. et al. . |
| 3,081,485 | 3/1963 | Steigerwald . |
| 3,433,947 | 3/1969 | Emanuelson . |
| 3,564,238 | 2/1971 | Martin et al. . |
| 3,628,987 | 12/1971 | Nakata et al. . |
| 3,673,409 | 6/1972 | Green . |
| 3,846,149 | 11/1974 | Meunier . |
| 4,047,903 | 9/1977 | Hesse . |

FOREIGN PATENT DOCUMENTS

| | | |
|---|---|---|
| 2101682 | 3/1972 | France . |
| 2294036 | 12/1976 | France . |
| 1509069 | 4/1978 | United Kingdom . |
| 2031700 | 4/1980 | United Kingdom . |

OTHER PUBLICATIONS

Products Finishing, Jan. 1970, "A Better Idea for Curing Paint", pp. 129–139.

Products Finishing, Aug. 1971, "Coil Coater Installs Electron-Beam Curing", pp. 92–95.

*Primary Examiner*—Bruce C. Anderson

*Assistant Examiner*—Jack I. Berman

*Attorney, Agent, or Firm*—Harold M. Snyder; Paul A. Leipold

[57] ABSTRACT

An inerting chamber and enclosure or access member are formed such that the escutcheon plate or outer member of the closure is hinged and the same hinges may be utilized to both swing the escutcheon plate out for cleaning and servicing of the chamber and also if the fastening devices for the access plate are loosened may be utilized to swing the entire inerting chamber and access plate out of the way for servicing of the electron beam unit.

18 Claims, 6 Drawing Figures

INERTING CHAMBER FOR ELECTRON CURING OF RESIN COATED WEBS

BACKGROUND OF THE INVENTION

1. Field of the Invention

The invention relates to apparatus for curing resin material onto continuous webs of cloth or paper material. The invention particularly relates to the curing chamber used in formation of coated abrasive materials by the high energy electron curing of resins in the formation of coated abrasives.

2. Prior Practices

It is known in the coated abrasive art to apply binder and abrasive grains to a paper or cloth substrate which is cured yielding sufficient strength for the following applications, subsequently the size coat is applied and the product completely cured. Suitable binders are for example glutelin glue, phenolic resins and, if water proof papers are desired, polyurethane resins, epoxy resins and alkyd resins, possibly in combination with melamine resins. Special requirements as related to technique, apparatus and time are necessary for the curing process. To avoid destruction of the substrates usually consisting of polyester or cellulose, curing should be effected at a maximum temperature of 120° to 130° C. Rapid curing allowing for the use of a horizontal dryer is difficult, because of the formation of gas bubbles affecting the adhesion of the resin on the substrate. The drying of the coated material sufficient to be rolled for curing generally requires several hours, and is therefore generally carried out in a festoon oven. Curing also may be carried out on a flat bed device. The festoon oven through which the coated web material is passing, enable a long drying or partial cure process, but there are also disadvantages, such as the formation of defects where the material is suspended, sagging of the binder and changing of the grain position due to the vertical suspension, variation of temperature and the resulting inconsistant crosslinking of the binder produced by the necessary slow air circulation. After removal from the festoon oven, it is then necessary to completely cure the rolls of partially cured abrasives by slowly heating in an auxiliary oven. Slow heating is necessary to prevent an uneven cure caused by widely different temperatures between the outside and inside of the rolls.

It is also known to produce abrasives by coating a substrate using a photopolymerizable curable synthetic resin as well as abrasive grains and by subsequently curing the applied layer by means of infrared radiation. The relatively long curing period of the synthetic resin is a disadvantage of this processing method. Owing to the long curing period and the elevated temperature the substrate is also strongly attacked. Furthermore the processing speed is low during the production of abrasives.

There are several disadvantages of the predominant commercial practice of forming coated abrasives. There are several curing steps in the typical process for formation of waterproof cloth-backed abrasives. The major areas of production may be considered as first the cloth treatment to prepare resin treated base cloth for application of abrasives and second the making of the coated abrasives using the previously prepared base cloth. The base cloth is coated with at least one backing coat of resin which impregnates the cloth with resin and fills interstices in the back of the cloth. The backing cloth is also coated with at least one face coat that fills interstices of the cloth on the side where abrasive grain is placed. The face coat(s) of the backing cloth also aids in adhesion of the coats containing the grains onto the cloth.

The second major area of coated abrasive formation is the drying or partial curing of the make coat which contains the grain and drying or partial cure of the size coat which is an overcoat placed onto the coated abrasive after the grain is at least partially cured and adhered onto the backing by the make coat. There may be pre-size coats prior to the make and size coats utilized in some instances. The partial curing of the make and size coats as set forth above generally is done in a lengthy festoon dryer that requires a tremendous amount of floor space and energy. In some cases, complete cure is carried out in the festoon dryer rather than the more common partial cure followed by complete cure in an auxiliary dryer. Further, both the festoon and auxiliary ovens where the curing takes place over a long period are difficult to completely control for accurate temperature. There also is the problem of the resin and grain shifting positions during curing because of the long hang times in the partially cured or uncured form. Then after removal from the festoon oven, further energy is used in the oven treatment of the rolls to obtain complete cure.

It has been suggested in the U.S. Pat. No. 4,047,903 Hesse et al that the formation of coated abrasives be carried out with at least one layer of the resin being cured by electron beams. However, there has remained a need for apparatus which would allow the commercial exploitation of electron beam curing. Hesse et al does not set forth apparatus that would allow the continuous formation of coated abrasives. There are extensive difficulties in commercial exploitation of electron beam curing. The conventional electron beam units are not accessible for easy cleaning. The conventional units do not allow rapid adjustment for curing from either side of the web carrying the coated abrasive. The installations may be bulky with walls of cement about 3 feet thick. Further, the conventional electron beam units do not allow easy stringing of new web material into the machine for rapid changeovers from one material to another.

When forming coated abrasives, there may be required very thick coats of resin compared with prior uses of the electron beam. The resins necessary also are very sticky prior to being completely cured. Therefore, multiple path systems such as disclosed in some prior electron beam curing systems such as U.S. Pat. No. 3,022,543 are not satisfactory since if the resins touch a roller the system will gum-up and not perform. Another difficulty with the formation of abrasives with electron beam curing apparatus such as presently available is that in coated abrasive formation there is always a certain amount of abrasive grain which becomes detached from the coated abrasive during formation and can detrimentally affect the equipment if it is not possible to regularly clean and maintain the equipment. The equipment becomes contaminated by adhesive buildup and by material such as abrasive grit and dirt which becomes embedded in the adhesive. Another difficulty is that, generally, coated abrasives are made with multiple changes of grit size, backings and resin coatings. Therefore it is necessary to stop and start the system at relatively frequent intervals. Present systems of electron beam curing, designed for use in other arts, do not allow rapid cleaning and restringing of webs in the equipment. Therefore, application of present systems to coated abrasives would be impractical due to the excessive lost time production.

There is apparatus disclosed for electron beam curing of coated abrasives in copending application Ser. No. 172,722, filed July 28, 1980, issued as U.S. Pat. No. 4,345,545 on Aug. 24, 1982, hereby incorporated by reference, that provides a source of high energy electron radiation which is mounted in a chamber that comprises a series of boxes which are large enough to allow quick servicing of the electron beam unit and also ease of access by a person into the unit for cleaning and threading of the portions of the device which carry the web of coated abrasive into and from the chamber. Further, the apparatus allows easy adjustment to directly impinge the high energy electrons onto either side of the web material without the necessity of the web material having its uncured resin side contact a roller. The device also allows the use of one device for the four steps of coating both the backing coating and face coating onto a cloth to be used for coated abrasives and both the make and size coating in coated abrasive formation utilizing the same apparatus. The apparatus of the copending application may be set up either to apply and cure a fill face coat, or fill backing coat or to apply the make coat, apply abrasive grain and cure the make coat, or to apply and cure a size coat over the abrasive grain. Further, the apparatus of U.S. Pat. No. 4,345,545 may be set up to cure the resin make and size coats or backing and face fill material from either the wet resin side or from the back of the substrate away from the wet side. There is a need for an effective, easily cleansed and threaded inerting chamber for use with the apparatus of U.S. Pat. No. 4,345,545.

Therefore there remains a need for apparatus which will allow formation of coated abrasives in a low-cost commercially satisfactory manner.

BRIEF DESCRIPTION OF THE INVENTION

It is an object of this invention to overcome disadvantages of the prior methods and apparatus for forming resin coated webs of paper and cloth.

It is a further object of this invention to overcome disadvantages of the prior methods and apparatus for forming coated abrasives.

It is another object of this invention to form improved coated abrasives.

It is a further object of this invention to form apparatus for electron beam curing in which the inerting chamber may be quickly cleaned.

It is an additional object of this invention to form apparatus for forming coated abrasives which may be easily threaded with webs.

It is another further object of this invention to form electron beam curing apparatus in which the inerting chamber, the electron beam window and the electron generator are easily and quickly cleaned and/or serviced.

It is another further object of this invention to provide electron beam curing in a continuous manner for coated cloth and coated abrasive materials.

It is an additional object of this invention to provide apparatus for electron beam curing of resin coated webs with only a small loss in "up" time for the cleaning of the apparatus.

It is another object of this invention to provide improved uniform continuous coated abrasive materials.

These and other objects of the invention are generally accomplished by providing an inerting chamber which is open enough to permit easy passage of the web material through the slot while providing for minimum usage of inerting gas and incorporating a positioning device which allows quick and easy opening of the inerting chamber to rapidly expose the slot through which the web passes for cleaning. In formation of coated abrasives or any resin coated material, it is necessary that any dirt be quickly cleaned from the passageway and the window as the buildup of resin material or abrasives could quickly deteriorate the quality of the material being formed or lead to jams of the equipment. The system of the invention also allows easy access for cleaning of the window between the electron beam generator and the inerting chamber. The system of the invention futher provides that the entire inerting chamber and end piece of the electron beam unit may be positioned out of the way for easy servicing of the electron beam gun or even removal of the electron beam gun.

In a preferred embodiment, the inerting chamber and enclosure or access member are formed such that the escutcheon plate or outer member of the closure is hinged and the same hinges may be utilized to both swing the escutcheon plate out for cleaning and servicing of the chamber and also if the fastening devices for the access plate are loosened may be utilized to swing the entire inerting chamber and access plate out of the way for servicing of the electron beam unit.

DETAILED DESCRIPTION OF THE INVENTION

There are numerous advantages in the system of the instant invention. The apparatus of the instant invention allows the web wet with resin to be irradiated from either the wet side or through the backing material by the electron beam without need for the wet side of the web to touch a roll or the inerting chamber prior to being cured. Further the instant apparatus allows easy servicing of the electron beam gun without lengthy shut-down times. The instant apparatus also allows cleaning of abrasive materials from the apparatus including the electron beam window with convenience and speed. A further advantage is that the use of inerting gas is relatively low as there is a small gas box in the irradiation zone which is the only area inerted. Inerting is necessary as oxygen interferes with the electron beam crosslinking of resins. The operation and advantages of the apparatus of the invention will become more apparent from the following description of the drawings.

Figure 1:
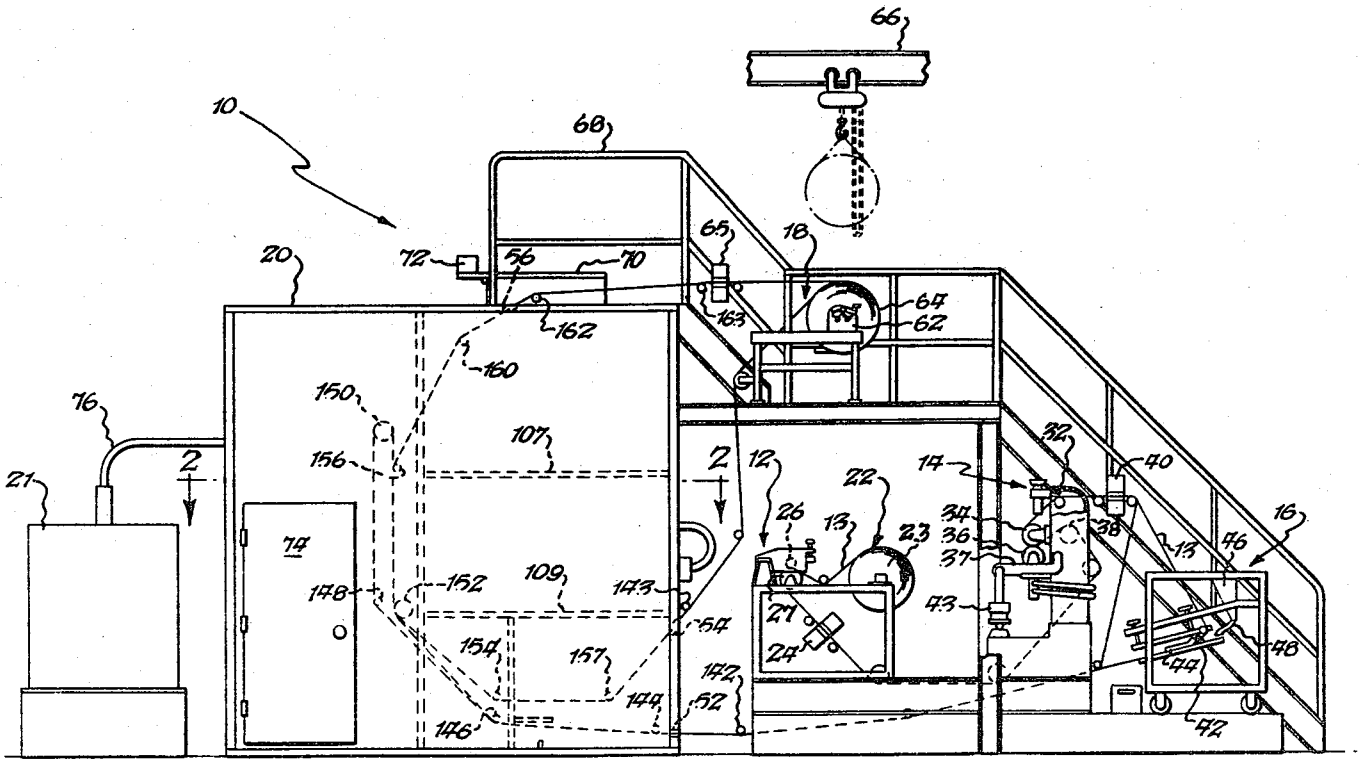
FIG. 1 is a view of the apparatus incorporating the chamber of the instant invention.

FIG. 1 illustrates the set-up of a high energy electron curing apparatus system 10 showing the alternative pathways for the alternative uses of the apparatus. The apparatus 10 is composed of an unwinder 22, printer 12, coater 14, electrostatic grain applicator 16 and electron beam chamber 20. Also illustrated is the high voltage power supply 21 and winder roll 18. The unwinder 22 holds supply roll 23 into which may be placed the blank cloth, paper or polymer sheet to be treated with a backing coat, face coat or the resin treated cloth which will be treated with a make coat prior to putting grain on the cloth or a roll of abrasive which has grain on it but which is placed into the unwinder 22 for treatment with a size coat over the grain. The printer 12 utilizes a roll 26 to print the necessary descriptive material on the back of the cloth or paper backing. Such information as the grit size, recommended use of the coated abrasive and trademarks are printed on the backing. The print roll 26 runs against impression roll 27. Element 24 is a beta gauge device for measuring the weight of the web leaving roll 23. The coating device 14 is known in the art as is the printer 12. The coating device 14 may utilize a doctor-blade coater 32 to apply a resin onto the web 13 or may use a transfer rubber roll 36 in sump 37 to apply resin to the web being passed through the apparatus. Rolls 34 and 36 are utilized to carefully control the web during coating. Beta gauge measuring device 40 measures the weight of the coating to insure the ability to control for accurate coating. Coating thicknesses of about 20 mils may be applied in coated abrasive formation. Pressure supply 43 adjusts the coating roll pressure on the web during coating to control resin weight.

After leaving the coater 14 the web, if it is to be coated with abrasive grain, passes to the electrostatic coater generally indicated as 16. The electrostatic coater, known in the art, comprises a system whereby abrasive grain is applied to a vibrating lower plate 42. A belt and grid could be used rather than a plate. The web 13 passes against grounded plate 44 leaving a gap between the web 13 held against plate 44 and the lower electrostatically charged plate 42. The abrasive grains are attracted by the electrostatic charge and embed themselves in the wet resin on the web 13. By this method the points of the grains are oriented upward away from the web surface for best cutting. A source of abrasive grain 46 is applied to lower plate 42 by the vibratory feeder 48. The rate of application is controlled by means not shown to provide a continuous moving layer of particles on vibratory feeder plate 42. Other electrostatic feeder arrangements may be utilized if desired.

The web 13 enters the equipment vault 20 at 52 and if radiated by the electron beam from the wet face side exits at 54 or if subjected to the electron beam from the backside exits at 56. The tracking within the equipment vault 20 will be described in more detail below. After exiting the equipment chamber where the curing by electron beam takes place the cured treated web 13 is wound onto the winder device generally indicated as 18. The winder roll 64 driven by means 62 not shown in detail gathers and rolls the treated web 13 onto a roll which may be moved by overhead hoist 66. The roll, if it is to be further treated, is then moved down to the location of the supply roll 22 or a finished product may be stored or moved to final shipping or cutting. The stair and railing 68 provides access to the upper portion of the radiation equipment vault and to the winder roll. Guard 70 counter-balanced by weight 72 provides shielding for the exit 56. Access door 74 provides entry for people into the radiation equipment vault for maintenance and threading of the web through the conveyor rollers and the inerting chamber. The beta gauge 65 allows measuring the weight of the total weight of make coat. The equipment vault walls are generally of 3-inch thick steel with lead lining in critical areas as will be set forth in more detail below.

Figure 2:
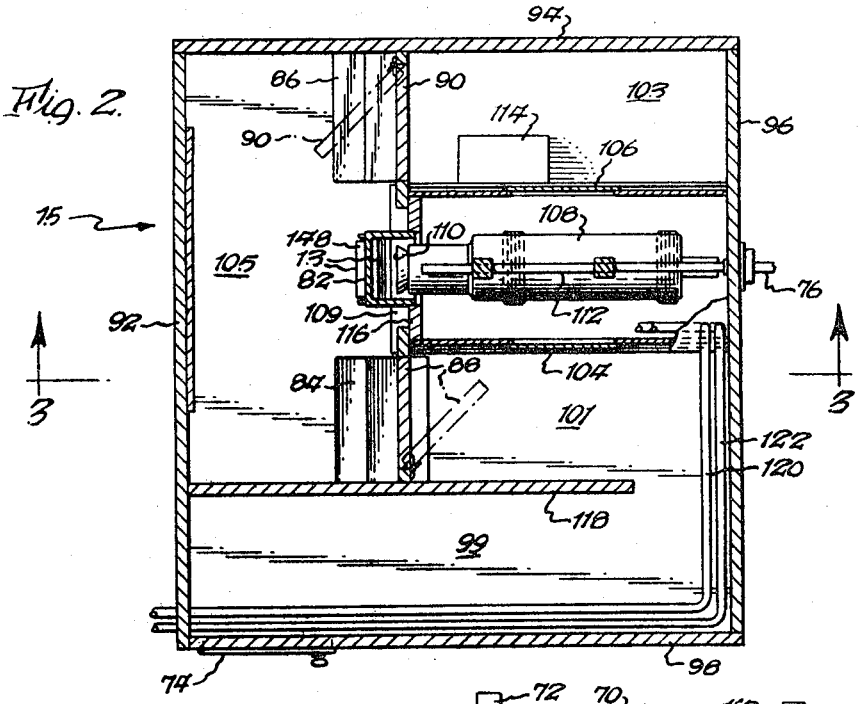
FIG. 2 is a cross section of the electron beam chamber taken along section line 2—2 of FIG. 1.
Figure 3:
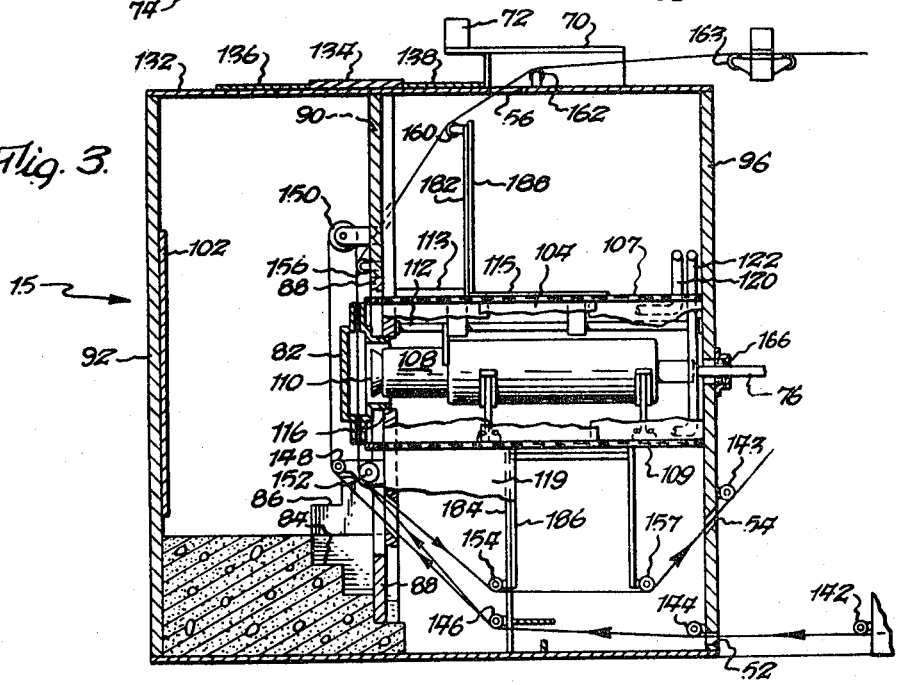
FIG. 3 is a sectional view of the electron beam chamber taken along section line 3—3 of FIG. 2.

FIGS. 2 and 3 illustrate the equipment vault housing the electron beam unit with special emphasis as to the shielding and service features of the equipment vault and electron beam curing apparatus system. FIG. 2 is a section along line 2—2 of FIG. 1 taken just above the electron beam curing unit. FIG. 3 is a view taken along line 3—3 of FIG. 2 that illustrates the mounting of the electron beam gun, shielding within the equipment vault for the electron beam unit and the multiple pathways for the web which allow curing from either face of the web. The radiation equipment vault generally indicated as 12 is formed of a front wall 92, back wall 96 and side walls 94 and 98. There is a door 74 in the side 98. Entrance through door 74 is into area 99 which constitutes an entrance-way and also is shielded by partition 118, commonly referred to as a maze. Partition 118 and all four sides of the equipment vault 12 as shown are formed of 3-inch thick steel. The steel is covered with lead at points of increased need for radiation control. After entry through passageway 99 the service area around the electron beam gun 108 is identified as areas 101 and 103. It is noted that areas 101 and 103 are joined above the chamber which houses the electron beam generating unit. From area 101 the target chamber 105 is entered by door 88 up stairs 84. Target chamber 105 has a floor which is at easy working level for servicing the inerting chamber 82. Further, it is noted that directly opposite the inerting chamber of the invention 82 the target area steel wall is covered with about 3 inches of lead to provide further protection from radiation in the surrounding areas. Access to area 103 is up stairs 86 through door 90. It is noted that the entire enclosure of the vault is a generally square floor area. Area 103 has easy access to service the electron beam generating unit and also to aid in stringing of the webbing to be cured by the unit 108. Step 114 aids in reaching the upper portion of the chamber for web manipulation.

The electron beam generating unit 108 is entirely enclosed within the container of which the sides 106 and 104 are illustrated in FIG. 2 and the upper and lower portions 107 and 109 are illustrated in FIG. 3. This inner chamber is formed of about 1-inch steel panels with additional radiation absorbing material comprising about 1½ inches of lead on all four sides of about the third of the chamber towards the inerting box 82, about one inch of additional lead on the middle third of the chamber and about ½ inch additional lead on the rear portion of the chamber. Further it is noted that the electron beam generating unit may be adjusted and moved for service along suspending steel rod 112. Tubes 120 and 122 bring cooling gases into the equipment cavity for cooling of the electron beam window 224. Inerting gas, as is known, is necessary for the effective electron beam curing of resins as oxygen interferes with the curing. The inerting gas, normally nitrogen, enters the inerting chamber 82 from storage tanks (not shown) outside the chamber by pipes (not shown).

With particular reference to FIG. 3 there is illustrated that the ceiling 132 of the equipment vault 12 contains additional lead shielding material. The ceiling has 2½ inches of lead over the 1 inch steel plate ceiling at the portion directly above the inerting chamber. Extending on each side of the 2½ inch thick portion are 1-inch thicknesses of lead 136 and 138. Then further lead of about ½ inch thickness extends to the edge of the roof 132. There is also additional lead shielding 186 and 188 of 1-inch thickness on the shields 184 and 182, which shields also carry rollers 154 and 160, respectively. The shields 182 and 184 themselves are of 1-inch steel. As illustrated, the equipment vault sits on the ground floor and therefore does not need additional radiation absorbing materials on the bottom portion. If placed on the second floor of a building it is likely that additional lining at the bottom would be required. To determine if additional radiation protection is needed, a survey with a radiation measuring device is carried out for any areas of higher radiation than 0.25 millirems per hour. Then, additional shielding is added to any areas of higher radiation.

Figure 4:
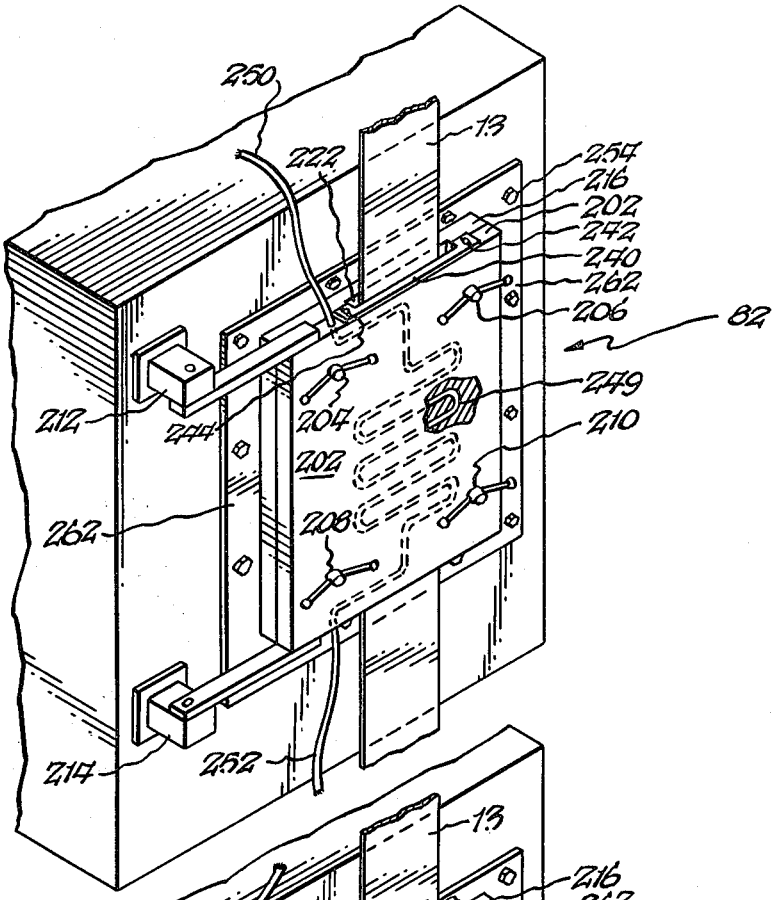
FIG. 4 is a view of the inerting chamber of the invention when in operating position.
Figure 5:
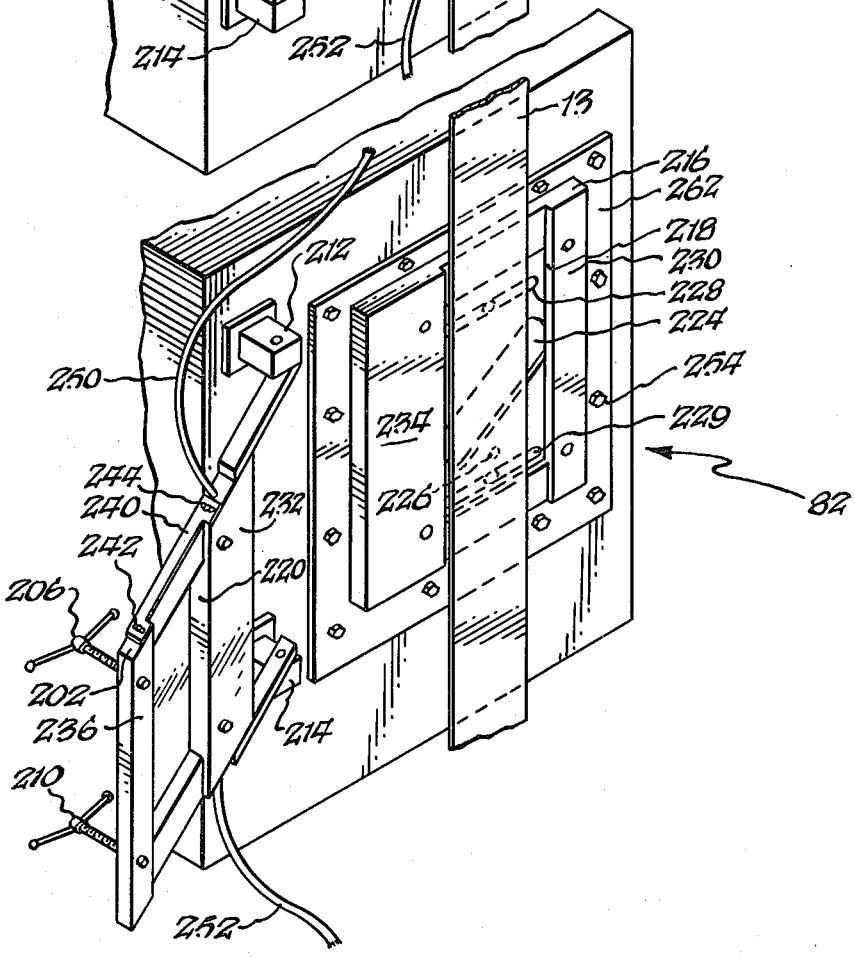
FIG. 5 is a view of the inerting chamber of the invention with the chamber opened.
Figure 6:
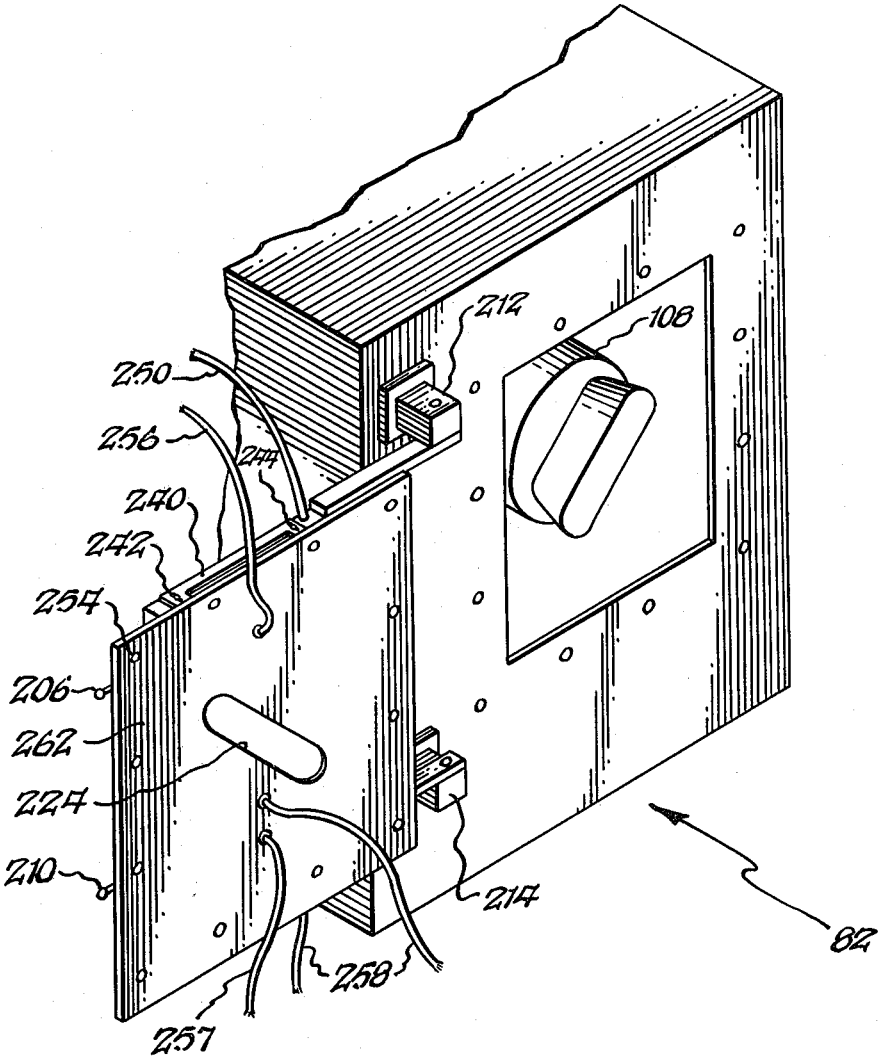
FIG. 6 is a view of the inerting chamber of the invention positioned so as to allow service of the electron beam generating unit.

FIGS. 4, 5 and 6 provide a more detailed view of the inerting chamber of the invention illustrating the advantages of the system which allow both ease of opening for cleaning of the inerting chamber and stringing of the web with further ease of access to the electron beam gun for its servicing or removal. The chamber is generally indicated as 82. The escutcheon or outer face plate 202 is fastened to close the inerting chamber by tightening captive screws 204, 206, 208 and 210. The escutcheon 202 is suspended on hinges 212 and 214 which allow the escutcheon plate 202 to be swung clear after fastening devices 204, 206, 208 and 210 are loosened. The fastening devices are generally captive screws which fasten into the matching plate 216 which forms the other portion of the inerting chamber. As illustrated both plate 202 and 216 are milled or hollowed to form indented portions 218 and 220 which when the chamber is fastened shut form slot 222. While illustrated with each half of the plates forming the inerting chamber as containing a hollow portion, it is considered possible to form the entire slot on one plate with a flat plate forming the other portion. The slot in one instance has been successfully formed with about a two-inch depth, perpendicular to the web, at the entrance and exit and about a four-inch depth perpendicular to the web at the wider central portion of the inerting chamber. The width should be great enough that the resin bearing web does not touch the chamber sides. Inside the inerting chamber corresponding with aperture 225 is the window 224 of the electron beam generating unit where the electron beam is directed through aperture 225 to cure the resin. The window 224 generally is formed of a titanium film which allows passage of the high energy electrons. Fitting 226 leads to sensor (not shown) for sensing the inert gas concentration in the inerting chamber. While the inerting chamber is shown with two inlets 228 and 229 for inerting gas, it is within the scope of art to provide more inlets. Further, in this instance, as the web may run in either direction, it may be desirable to provide a gas inlet for the inerting gas at either end. The surfaces 230, 232, 234 and 236 are milled smooth to provide gas sealing to prevent escape of the inerting gas. They may also be gasketed, however, the electron beam generation, generally, is very destructive of most gasketing material and matching milled surfaces are generally a better solution.

In some instance it may be desirable to narrow the width of the slot 222 where the web enters the inerting chamber. In such instances, a plate 240 or other air entry control means may be adjustably mounted to the upper and also lower portions of the door so that it may be adjusted to close off part of the entering slot 222. It also would be possible to use plates to close off the edges of the slot in instances where the web being wound at that particular time was narrower than the full slot width. The plate 240 is adjustable by adjustment screws 242 and 244 operating in the slots of plate 240 to hold it in any desired position either partly over the slot 222 or completely out of the slot. Other plates for shutting the edges of the slot may be fabricated for use in running narrow materials. The escutcheon member also is provided with cooling by means of cooling fluid entering the escutcheon plate through tube 250 and exiting through tube 252. Generally the cooling fluid is water, but other gaseous or liquid mediums may also be utilized. The cooling water flows through cooling coils 249 laminated into plate 202.

With reference to FIG. 6, there is illustrated vault 82 with the inerting chamber of the invention when the access plate has been released from the housing vault 82 for the electron beam gun and swung out of the way for access to the electron beam gun 108 for service. Further, it provides access for easier changing of the window 224. The hoses 256 and 257 are the rear connections for the inerting gas such as nitrogen to enter the chamber. Further, the lead 258 is for the sensor for the nitrogen concentration in the inerting chamber which leads to a monitor not shown. The access plate generally is fastened down by a number of bolts or screws 254. When servicing the electron beam gun, captive screws 204, 206, 208 and 210 are not loosened, but all screws 254 are removed and then the entire inerting chamber swings clear on hinges 212 and 214. After swinging away of the access plate and inerting chamber, the electron beam gun may be slid forward on rail 112 for easier servicing. While the mechanism for positioning the inerting chamber and access plate has been shown as a hinge, the positioning device could be another member such as a rail similar to 112 on which the electron beam gun is moved or even an overhead motorized crane. However, the hinges are satisfactory, reliable and cheap for the apparatus shown.

While the invention has been described as comprising primarily three parts, the escutcheon or face plate 202, the matching mating half of the inerting chamber 216 and the access panel 262, it is within the scope of the invention to utilize a unitary member for the access panel and the matching half of the inerting chamber. However, the desirability of easily cleanable and satin-resistant metal such as stainless steel for the inerting chamber leads to the formation of the two-section piece with a thick steel access plate 262 having a cut out opening for positioning of the half of the inerting chamber which matches with the escutcheon part forming the outer plate. Further, the matching portion of the inerting chamber itself may be formed of several pieces of metal which are bolted or welded together to form a unitary structure rather than being milled from a single piece.

The access plate and inerting chamber may be formed of thick metal in order to aid in radiation protection, although in this instance, the inerting chamber is formed inside a box-like structure for housing the apparatus, this is less necessary. Regardless of whether the structure is formed of two plates or a series of plates bolted or welded together to form the structures of the instant invention, the device having the easily positioned outer member which opens for cleaning and stringing of the web but closes to form a very tight fitting, small inerting chamber for minimal use of inerting gas, is retained. Further, the utilization of a structure where the entire inerting chamber plus the access plate for the electron beam unit easily is positioned out of the way for quick servicing are important features of the instant invention which allow the advantages indicated.

The foregoing description of the invention has been directed to a particular preferred embodiment for purposes of explanation and illustration. It would be apparent, however, to those skilled in the art, that many modifications and changes in the apparatus may be made without departing from the spirit and scope of the invention. For instance, while the inlets for the inerting gas have been shown in the upper portion of the chamber, and at the bottom portion, there could be several other entrances for the inerting gas. Further, while the fastening devices have been shown as bolts and hand cranks, the fastening devices could be latches or pressure devices. Further, while the inerting chamber and access plate have been shown as swinging to the side, they also could be mounted so as to swing down, up or be caried out of position by a conveyor device.

It will be obvious further, that the invention may be utilized with suitable modifications within the state of the art in other types of electron beam curing apparatus than that shown. For instance, the inerting chamber could be utilized with a device that was intended to only operate in a single direction rather than the back or front curing options of the shown apparatus. Further, the chamber could be utilized with different slot sizes for treatment of materials other than thin webs, such as groups of yarn. Further, it would be within the scope of the art to more heavily construct the instant device with radiation protection materials if it was not used within the shown chamber. These and other modifications of the invention will be apparent to those skilled in this art.

What is claimed is:

1. Apparatus for electron beam curing comprising a source of high energy electrons, an outer plate-like escutcheon member and apertured access member adopted to join said escutcheon member wherein (a) at least one of said members is formed with a concave area such that when said members are joined, a slotlike opening is formed;

(b) adjustable positioning means are provided to position said escutcheon member in contact or removed from said access member;

(c) there are provided releasable means to secure said access member such that said source of high energy electrons is directed through the aperture;

(d) releasable means are provided to secure said escutcheon member to said access member; and (e) said positioning means are adapted to simultaneously remove both said access member and said escutcheon member when they are secured together and said releasable means securing said access member to said source of high energy electrons is released.

2. The apparatus of claim 1, wherein said slotlike opening is of less cross-section at the entrance and exit than at the area of said aperture.

3. The apparatus of claim 1, further comprising means for supplying inert gas to said slotlike opening.

4. The apparatus of claim 1, wherein said escutcheon member further comprises cooling means.

5. The apparatus of claim 1, wherein said apertured access panel has an opening the shape of which generally corresponds to the shape of the source of high energy electrons.

6. The apparatus of claim 1, wherein removal of said access panel allows servicing and withdrawal of the electron beam device.

7. The apparatus of claim 1, wherein each member has a concave portion which, when placed in mating position, form an inerting chamber.

8. The apparatus of claim 1, wherein the entrance and exit to the slot are provided with adjustable devices to increase or decrease the area of the entrance and exit.

9. Apparatus for high energy electron beam treatment comprising a housing for a source of high energy electrons, access means for gaining access to said housing, said access means comprising an interior plate and an escutcheon plate, a passage provided between said interior plate and said escutcheon plate for passage of material through said access means.

10. The apparatus of claim 9, wherein at least one of said interior plate and escutcheon plate is provided with a concave portion to form said passage when joined with the matching escutcheon plate or interior plate.

11. The apparatus of claim 9, further comprising means for supplying inert gas to said passage.

12. The apparatus of claim 9, further comprising means for partially blocking the entrance and the exit of said passage.

13. The apparatus of claim 9, wherein positioning means are attached to said escutcheon plate.

14. The apparatus of claim 13, wherein said escutcheon member is releasably attached to said interior plate.

15. The apparatus of claim 13, wherein said positioning means is adapted to position both the escutcheon plate and said interior plate at a position removed from said housing.

16. The apparatus of claim 14, wherein said positioning means is adapted to position the escutcheon plate at a removed position from said interior plate for service.

17. The apparatus of claim 11, further comprising a fitting and lead to permit detection of inert gas concentration in said passage.

18. The apparatus of claim 9, further comprising cooling means located in said escutcheon plate.

* * * * *